US008631552B2

(12) United States Patent
Kuntz

(10) Patent No.: US 8,631,552 B2
(45) Date of Patent: Jan. 21, 2014

(54) PLATE JOINT FOR A PARTS FIXTURE MADE OF CARBON FIBER COMPOSITE

(75) Inventor: Jonathan Kuntz, Johnsonburg, PA (US)

(73) Assignee: SGL Carbon SE, Wiesbaden (DE)

( * ) Notice: Subject to any disclaimer, the term of this patent is extended or adjusted under 35 U.S.C. 154(b) by 456 days.

(21) Appl. No.: 12/973,402

(22) Filed: Dec. 20, 2010

(65) Prior Publication Data

US 2012/0151745 A1 Jun. 21, 2012

(51) Int. Cl.
*B27F 7/15* (2006.01)

(52) U.S. Cl.
USPC ..... 29/432; 29/417; 29/822; 52/692

(58) Field of Classification Search
USPC ..... 29/525.01, 417, 432, 822; 52/692–693; 227/152; 411/477
See application file for complete search history.

(56) References Cited

U.S. PATENT DOCUMENTS

| | | | | | |
|---|---|---|---|---|---|
| 2,097,172 | A * | 10/1937 | Yurkovitch | 403/219 |
| 3,879,906 | A * | 4/1975 | Hollenberg | 403/346 |
| 5,185,982 | A * | 2/1993 | Hostetler | 52/646 |
| 5,832,689 | A * | 11/1998 | Curll | 52/656.9 |
| 6,051,089 | A * | 4/2000 | Palmer et al. | 156/92 |
| 6,322,308 | B1 * | 11/2001 | Grant | 411/429 |
| 2006/0162277 | A1 * | 7/2006 | Schultz | 52/741.4 |
| 2012/0247038 | A1 * | 10/2012 | Black | 52/220.1 |

* cited by examiner

*Primary Examiner* — Minh Trinh
(74) *Attorney, Agent, or Firm* — Taylor IP, P.C.

(57) ABSTRACT

A plate joint for joining two plates together includes a first plate and a second plate, with each of the first plate and second plate having a first edge and an opposite and generally parallel second edge. The first plate and second plate are connected together in a generally orthogonal orientation relative to each other with a finger joint defined by a notch in each plate which interlock with each other. The first edge of the first plate and the first edge of the second plate each have a groove therein which axially align with each other in and end-to-end manner. A locking pin is press fitted into the grooves in each of the first plate and the second plate.

28 Claims, 4 Drawing Sheets

PLATE JOINT FOR A PARTS FIXTURE MADE OF CARBON FIBER COMPOSITE

BACKGROUND OF THE INVENTION

1. Field of the Invention

The present invention relates to plate joints for joining plates together, and, more particularly, to parts fixtures including such plate joints.

2. Description of the Related Art

A parts fixture is typically used for holding parts during processing of the parts in an industrial process (with the phrase "industrial process" broadly defined herein to include any type of manufacturing or subsequent processing of parts). One such industrial process is thermally treating metal parts to obtain desired metallurgical properties. The thermal (or heat) treating process can occur onsite at a manufacturer, or the parts may be shipped to an offsite location for heat treatment. The parts to be heat treated are placed into the fixture and the loaded fixture is placed into an oven, vat, tank, etc. during the heat treating process.

A parts fixture as described above may be made in a multi-layer configuration, with parts to be treated being placed on each different layer, and the entire multi-layer fixture then processed for heat treatment of the retained parts. Such heat treatment occurs at elevated temperatures; and thus it is desirable to construct the fixture from a material which does not physically deteriorate, is dimensionally stability, and retains the original shape during thermal expansion and contraction.

In order to load and unload a multi-layer parts fixture as described above, it is sometimes necessary to assemble and disassemble the parts fixture for each load of parts. As the components making up the fixture are repeatedly assembled and disassembled, they may become worn over time, which may lead to changes in the dimensions and/or shape of the parts fixture. If the parts are loaded on top of each layer, the upper surface of the layer may not be flat, which can then lead to distortion of the parts during the heat treating process.

What is needed in the art is a joint for plates, e.g., in a parts fixture, which is robust and maintains dimensional and structural integrity.

SUMMARY OF THE INVENTION

The present invention provides a plate joint with a pair of plates connected together using a finger joint, and a locking pin which is press fit into a groove which extends across a common edge of each of the plates.

The invention in one form is directed to a plate joint for joining two plates together. The plate joint includes a first plate and a second plate, with each of the first plate and second plate having a first edge and an opposite and generally parallel second edge. The first plate and second plate are connected together in a generally orthogonal orientation relative to each other with a finger joint defined by a notch in each plate which interlock with each other. The first edge of the first plate and the first edge of the second plate each have a groove therein which axially align with each other in and end-to-end manner. A locking pin is press fitted into the grooves in each of the first plate and the second plate.

The invention in another form is directed to a parts fixture for holding parts to be processed during an industrial process. The parts fixture includes a plurality of elongate plates arranged in a criss-cross configuration to define a generally flat fixture. Each plate is connected with at least one other plate using a plate joint. At least one plate joint includes a pair of plates, with each of the pair of plates having a first edge and an opposite and generally parallel second edge. The pair of plates are connected together in a generally orthogonal orientation relative to each other with a finger joint defined by a notch in each plate which interlock with each other. The first edge of each plate has a groove therein which axially align with each other in and end-to-end manner. A locking pin press is fitted into the grooves in each of the plates.

The invention in yet another form is directed to a method of joining two plates together, including the steps of: providing a first plate and a second plate, with each of the first and second plates having a first edge and an opposite and generally parallel second edge; connecting the first and second plates together in a generally orthogonal orientation relative to each other using a finger joint defined by a notch in each plate which interlock with each other; providing a groove in the first edge of each of the first and second plates, with the grooves axially aligning with each other in and end-to-end manner; and press fitting a locking pin into the grooves.

An advantage of the present invention is that a pair of plates which are connected via a finger joint are also additionally locked in an orthogonal orientation relative to each other using the groove and locking pin arrangement.

Another advantage is that the first edges of each of the pair of plates are held substantially coplanar to each other using the groove and locking pin arrangement.

Yet another advantage is that the groove is formed with a keyhole cross-sectional shape which allows the locking pin to be press fit into the groove, while at the same time ensuring the coplanar relationship between the common edges of the plates into which the locking pin is pressed.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
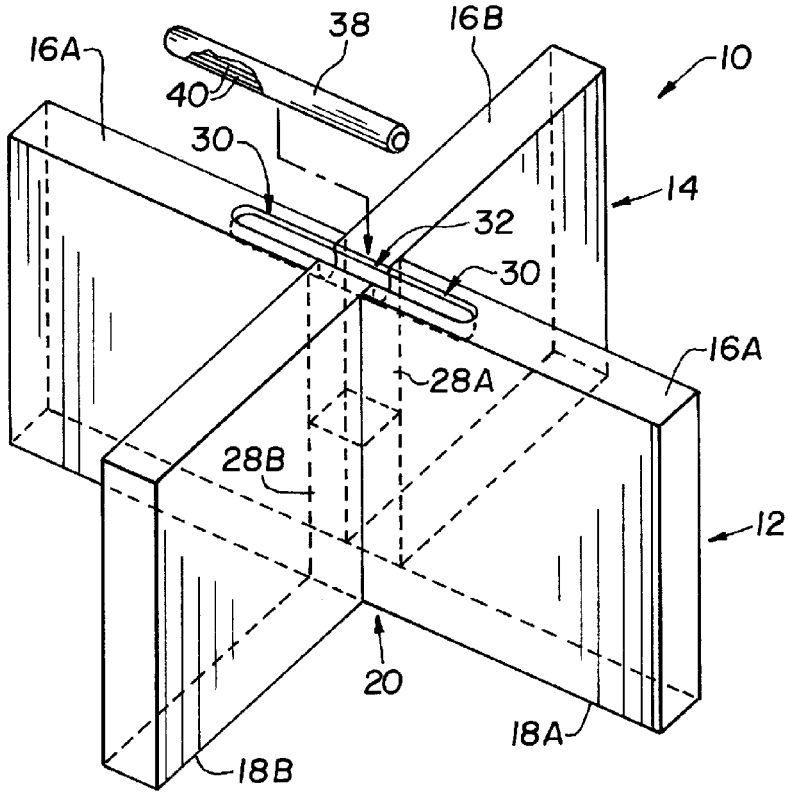
FIG. 1 is a perspective view of an embodiment of a plate joint of the present invention, with the plates connected via a finger joint and the locking pin not yet pressed into place within the groove.
Figure 3:
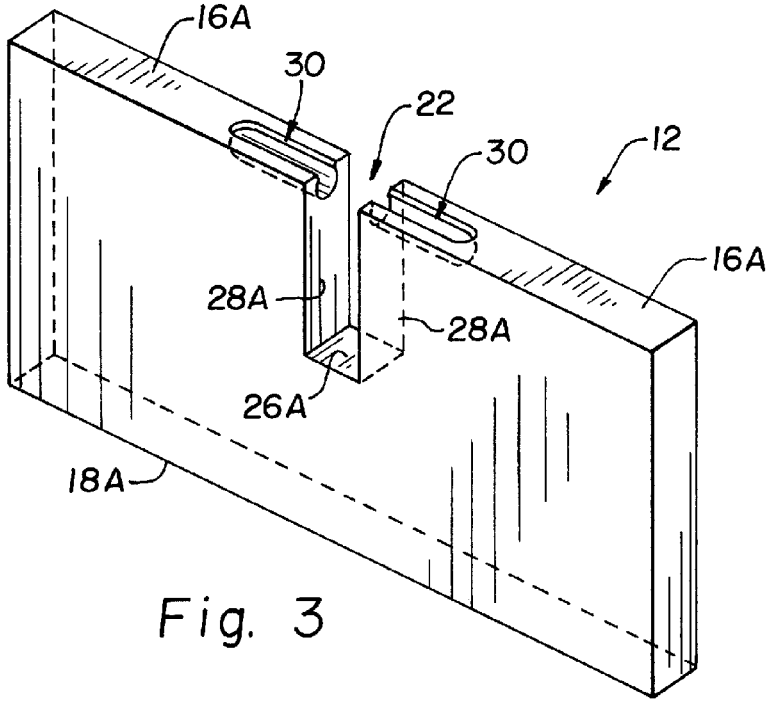
FIG. 3 is a perspective view of one of the plates shown in FIGS. 1 and 2.

Referring now to the drawings, and more particularly to FIGS. 1-5, there is shown an embodiment of a plate joint 10 for joining two plates 12 and 14 together. Plates 12 and 14 may have any desired length, width, and thickness, depending upon the application. Moreover, plates 12 and 14 may be constructed from any suitable material, depending upon the application. In the illustrated embodiment, plates 12 and 14 are assumed to be constructed from a carbon fiber composite (CFC), but could be constructed from a different type of material, such as fiberglass, wood, etc.

Plate 12 defines a first plate with a first edge 16A and an opposite and generally parallel second edge 18A. Likewise, plate 14 defines a second plate with a first edge 16B and an opposite and generally parallel second edge 18B. First edges 16A and 16B lie generally coplanar with each other, and second edges 18A and 18B also lie generally coplanar with each other.

First plate 12 and second plate 14 are connected together in a generally orthogonal orientation relative to each other with a finger joint 20 defined by a pair of notches 22 and 24 which are formed in each respective plate 12 and 14 and which interlock with each other. More particularly, first plate 12 includes notch 22 and second plate 14 includes notch 24, which interlock with each other to define finger joint 20 between first plate 12 and second plate 14. (The phrase "finger joint" is similar in concept to spreading the index and middle fingers of each hand, rotating one hand orthogonal relative to the other, and engaging the forked fingers of one hand with the forked fingers of the other hand).

Notches 22 and 24 formed in respective first and second plates 12 and 14 are generally rectangular notches. Notch 22 extends generally perpendicular from first edge 16A of first plate 12, and notch 24 extends generally perpendicular from second edge 18B of second plate 14. In the illustrated embodiment, each of notches 22 and 24 extend approximately half the distance of the width between first edge 16A, 16B and second edge 18A, 18B. However, notches 22 and 24 may have a different length, as long as the overall length of the combined notches 22 and 24 totals the width between the first and second edges 16A, 16B and 18A, 18B. For example, notch 22 in first plate 12 could extend two-thirds of the width between first edge 16A and second edge 18A, and notch 24 could extend one-third the width between first edge 16B and second edge 18B.

Notch 22 includes a base end 26A and a pair of generally parallel depending legs 28A which terminate at an opening of notch 22 lying coincident with first edge 16A. Likewise, notch 24 has a base end 26B and a pair of generally parallel depending legs 28B which terminate at an opening of notch 24 lying coincident with second edge 18B.

First plate 12 and second plate 14 each have a respective groove 30 and 32 therein, which axially align with each other in an end-to-end manner. Groove 30 formed in first edge 16A actually spans across the opening to notch 22. Groove 30 extends lengthwise in opposite directions away from notch 22 an equal distance on either side of notch 22. However, groove 30 could be shifted one way or the other slightly so as not to equally extend a common distance on either side of notch 22. Moreover, it may even be possible for some applications for groove 30 to only extend to one side of notch 22, rather than both sides of notch 22. Groove 32 formed in second plate 14 extends crosswise on first edge 16B and is in general axial alignment with notch 24 extending from second edge 18B.

Figure 5:
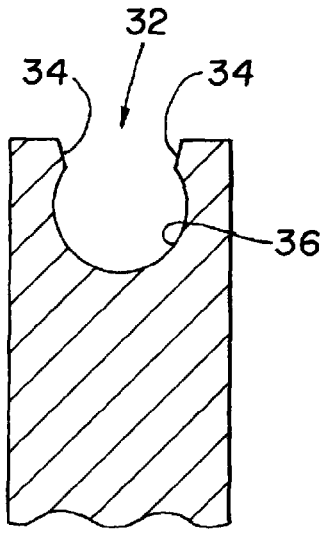
FIG. 5 is a sectional view taken along line 5-5 in FIG. 4, showing the cross-sectional shape of the groove.

Referring to FIG. 5, the cross sectional shape of groove 32 formed in second plate 14 is shown in greater detail. Groove 32 has a generally key-hole shaped cross section with a pair of opposite sidewalls 34 terminating at a circular profile 36. Sidewalls 34 are sloped inwardly to define a narrowing neck terminating at circular profile 36. It is to be understood that groove 30 formed in first plate 12 has a substantially identical cross sectional shape, whereby a locking pin (described in more detail below) may be press fit into both grooves 30 and 32.

Although mating grooves 30 and 32 are shown with a generally keyhole-shaped cross section as shown and described above, it is to be understood that mating grooves 30 and 32 may have a different cross sectional shape. For example, for some applications it may be desirable to form mating grooves 30 and 32 with a simple slot or U-shaped cross section with a width slightly less than the diameter of a corresponding locking pin 38 to provide a press fit arrangement.

Locking pin 38 is press fitted into aligned grooves 30 and 32 when finger joint 20 defined by notches 22 and 24 is assembled. Locking pin 38 has a diameter which is just slightly larger than the inside diameter of circular profile 36, thus establishing a press fit connection when locking pin 38 is positioned within grooves 30 and 32. The length of locking pin 38 is slightly less than the overall length of groove 30 formed on either side of notch 22 in first edge 16A. For the particular application shown in FIGS. 1-5, first and second plates 12 and 14 are formed from CFC and locking pin is likewise formed from CFC. Locking pin 38 may be pressed or hammered into grooves 30 and 32, and has a plurality of laminae extending the axial direction of locking pin 38 to avoid delamination during the pressing or hammering operation. Laminae 40 are shown in an exaggerated state on a portion of locking pin 38 illustrated in FIG. 1. It will be appreciated that the number of laminae, thickness of each lamina, etc. may vary, depending on the application. Moreover, locking pin 38 need not be formed from CFC but may be formed from a different material, depending on the application, such as metal, etc.

Figure 2:
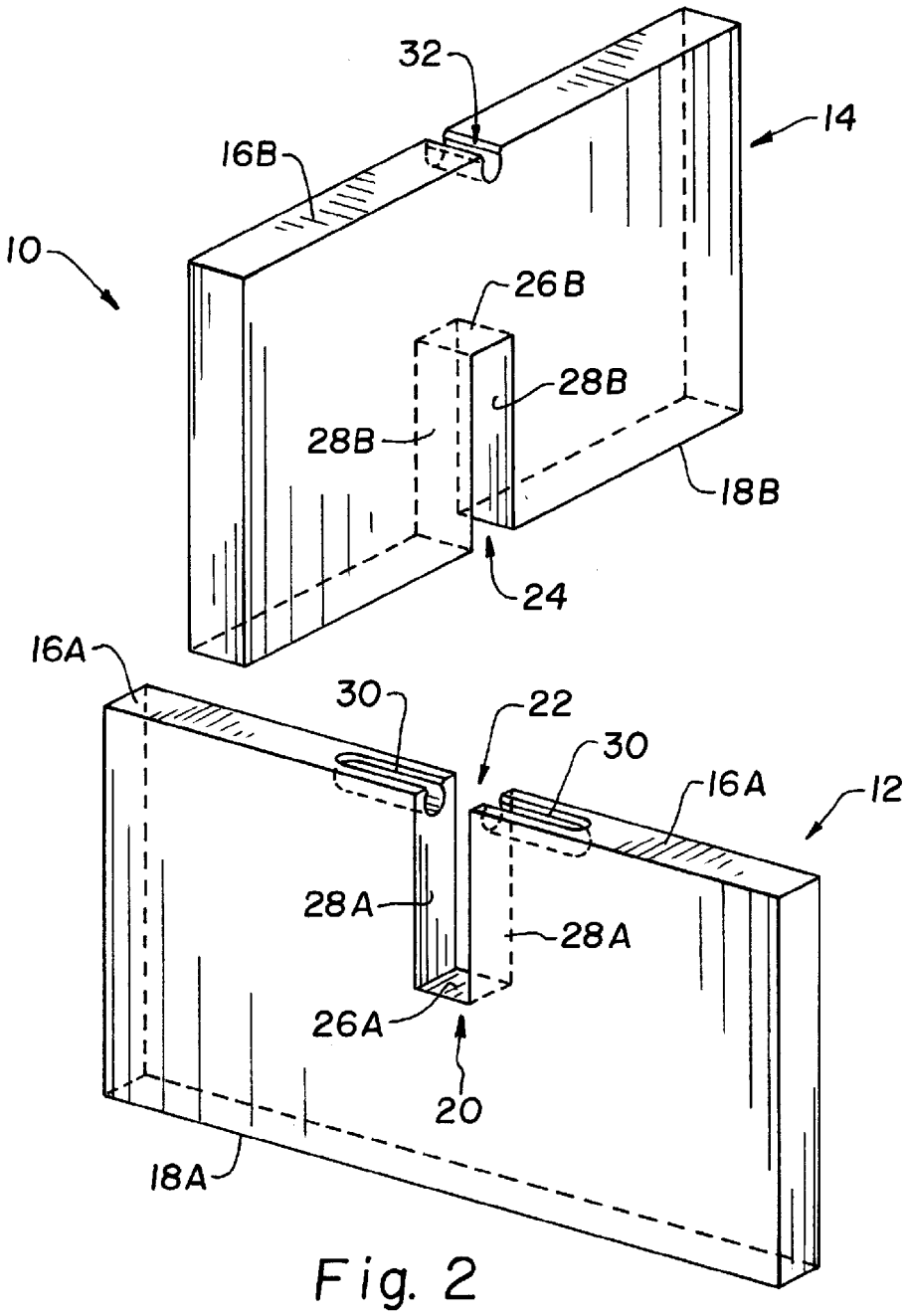
FIG. 2 is another perspective view of the plate joint shown in FIG. 1, with the plates disassembled.
Figure 4:
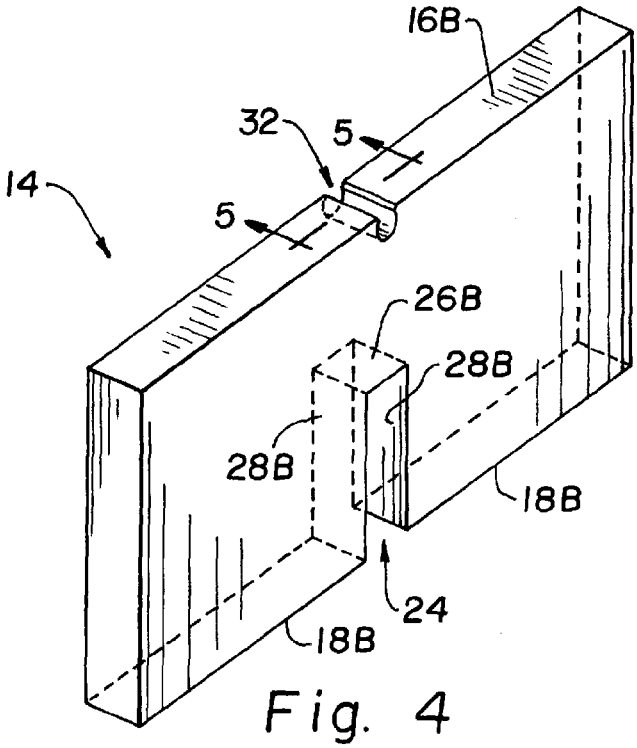
FIG. 4 is a perspective view of the other of the plates shown in FIGS. 1 and 2.

To join plates 12 and 14 together, notches 22 and 24 are aligned relative to each other and joined together as shown in FIGS. 1 and 2, such that first edges 16A and 16B are substantially coplanar with each other. First and second plates 12 and 14 are placed on a hard surface such that second edges 18A and 18B lie against the hard surface. Locking pin 38 is inserted into the aligned grooves 30 and 32, and may be hammered or pressed into the circular profile 36 of the aligned grooves 30 and 32.

Figure 6:
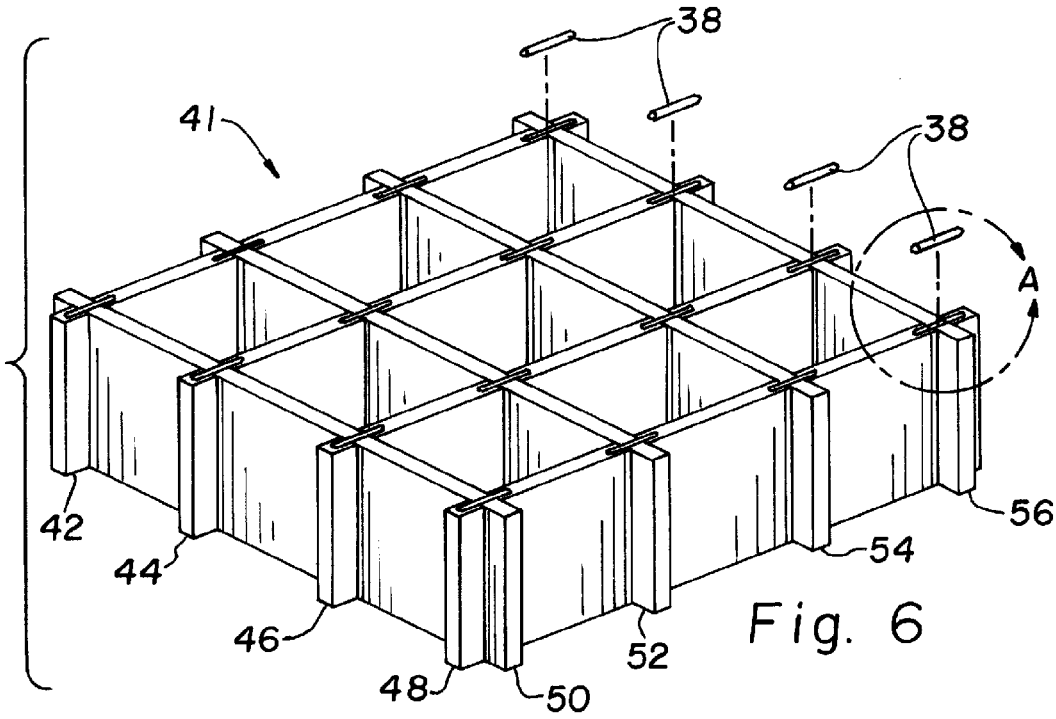
FIG. 6 is a perspective view of an embodiment of a parts fixture of the present invention, incorporating a number of plate joints as shown more generally in FIGS. 1-5.
Figure 7:
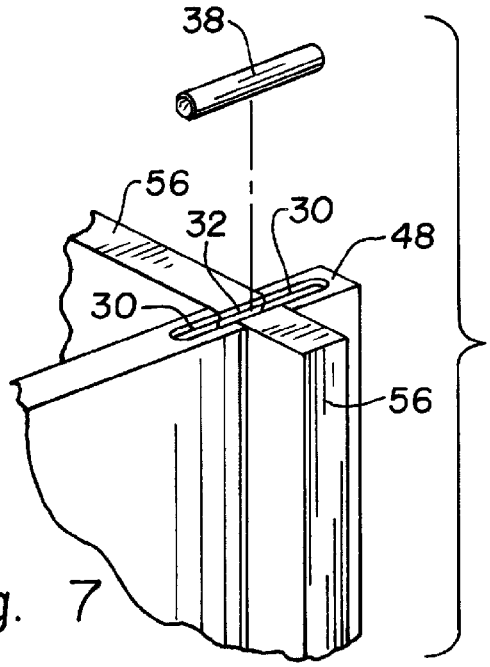
FIG. 7 is a detailed view of the groove and locking pin arrangement, as indicated at detail A in FIG. 6.

FIGS. 6 and 7 illustrate an embodiment of a parts fixture 41 used for heat treating metal parts. Parts fixture 41 defines a single layer or a multi-layer fixture, with the remaining layers not being shown in the drawings for simplicity's sake. It is to be understood that the layers typically are substantially identically configured and stacked on top of each other for receiving parts to be heat treated.

Parts fixture 41 incorporates a number of plate joints as shown more generally in FIGS. 1-5, and described in detail above. Plates 42, 44, 46 and 48 extending in a common direction generally parallel to each other are arranged in a criss-crossed configuration relative to plates 50, 52, 54 and 56. At the intersection of any two plates (not specifically numbered in FIG. 6) is a plate joint in the form of a finger joint as described above with reference to plate joint 10 shown in FIGS. 1-5. In the illustrated embodiment, all of the plate joints shown in FIG. 6 are assumed to be finger joints with a groove and locking pin arrangement for locking each respective joint in place. However, it should also be understood that for certain applications, it may not be necessary for every plate joint to have a groove and locking pin arrangement.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A plate joint for joining two plates together, said plate joint comprising:

a first plate and a second plate, each of said first plate and said second plate having a first edge and an opposite and generally parallel second edge, said first plate and said second plate connected together in a generally orthogonal orientation relative to each other with a finger joint defined by a notch in each plate which interlock with each other, said first edge of said first plate and said first edge of said second plate each having a groove therein which axially align with each other in and end-to-end manner; and a locking pin press fitted into said grooves in each of said first plate and said second plate.

2. The plate joint of claim 1, wherein said groove in said first plate extends lengthwise to said corresponding first edge, and said groove in said second plate extends crosswise to said corresponding first edge.

3. The plate joint of claim 2, wherein said groove in said first plate extends lengthwise in opposite directions away from a corresponding said notch formed in said first plate.

4. The plate joint of claim 3, wherein said first edge of said first plate and said first edge of said second plate lie generally coplanar with each other.

5. The plate joint of claim 1, wherein said notch formed in each of said first plate and said second plate are generally rectangular notches.

6. The plate joint of claim 1, wherein each said groove has a generally key-hole shaped cross section with a pair of opposite side walls terminating at a circular profile.

7. The plate joint of claim 6, wherein said side walls are sloped inwardly to define a narrowing neck terminating at said circular profile.

8. The plate joint of claim 1, wherein said notch in said first plate extends generally perpendicular from said first edge, and said notch in said second plate extends generally perpendicular from said second edge.

9. The plate joint of claim 1, wherein each said notch has a base end and a pair of generally parallel depending legs, said notch in said first plate opening at said first edge and said notch in said second plate opening at said second edge.

10. The plate joint of claim 1, wherein each of said first plate and said second plate are comprised of a carbon fiber composite.

11. The plate joint of claim 10, wherein said locking pin is comprised of a carbon fiber composite with a plurality of laminae extending in an axial direction of said locking pin.

12. A parts fixture for holding parts to be processed during an industrial process, said parts fixture comprising:

a plurality of elongate plates arranged in a criss-cross configuration to define a generally flat fixture, each said plate connected with at least one other plate using a plate joint, at least one said plate joint including:

a pair of plates, each of said pair of plates having a first edge and an opposite and generally parallel second edge, said pair of plates connected together in a generally orthogonal orientation relative to each other with a finger joint defined by a notch in each plate which interlock with each other, said first edge of each said plate having a groove therein which axially align with each other in and end-to-end manner; and a locking pin press fitted into said grooves in each of said plates.

13. The parts fixture of claim 12, wherein said groove in one of said pair of plates extends lengthwise to said corresponding first edge, and said groove in an other of said pair of plates extends crosswise to said corresponding first edge.

14. The parts fixture of claim 13, wherein said groove in said one plate extends lengthwise in opposite directions away from a corresponding said notch formed in said one plate.

15. The parts fixture of claim 14, wherein said first edge of said one plate and said first edge of said other plate lie generally coplanar with each other.

16. The parts fixture of claim 13, wherein said notch in said one plate extends generally perpendicular from said first edge, and said notch in said other plate extends generally perpendicular from said second edge.

17. The parts fixture of claim 16, wherein each said notch has a base end and a pair of generally parallel depending legs, said notch in said one plate opening at said first edge and said notch in said other plate opening at said second edge.

18. The parts fixture of claim 12, wherein said notch formed in each of said pair of plates is a generally rectangular notch.

19. The parts fixture of claim 12, wherein each said groove has a generally key-hole shaped cross section with a pair of opposite side walls terminating at a circular profile.

20. The parts fixture of claim 19, wherein said side walls are sloped inwardly to define a narrowing neck terminating at said circular profile.

21. The parts fixture of claim 12, wherein each of said pair of plates are comprised of a carbon fiber composite.

22. The parts fixture of claim 21, wherein said locking pin is comprised of a carbon fiber composite with a plurality of laminae extending in an axial direction of said locking pin.

23. The parts fixture of claim 21, wherein said industrial process is a process of heat treating metal parts.

24. A method of joining two plates together, said method comprising the steps of:

providing a first plate and a second plate, each of said first plate and said second plate having a first edge and an opposite and generally parallel second edge;

connecting said first plate and said second plate together in a generally orthogonal orientation relative to each other using a finger joint defined by a notch in each plate which interlock with each other;

providing a groove in each of said first edge of said first plate and said first edge of said second plate, said grooves axially aligning with each other in and end-to-end manner; and press fitting a locking pin into said grooves.

25. The method of claim 24, wherein each of said pair of plates are comprised of a carbon fiber composite.

26. The parts fixture of claim 25, wherein said industrial process is a process of heat treating metal parts.

27. The method of claim 24, wherein said step of providing a groove comprises concurrently milling said groove into said first edge of said first plate and said first edge of said second plate after said first plate and said second plate are connected together.

28. The method of claim 24, wherein said press fitting step comprises hammering said locking pin into said grooves.

* * * * *